US005628259A

United States Patent [19]

Kuennen et al.

[11] Patent Number: 5,628,259

[45] Date of Patent: May 13, 1997

[54] ECONOMIZER LUMP BREAKER

[75] Inventors: Larry E. Kuennen, Cleveland; Ronald G. Madron, Pawnee; Gary M. Crisp; Randy A. Dailey, both of Ponca City, all of Okla.

[73] Assignee: Oklahoma Gas and Electric Company, Oklahoma City, Okla.

[21] Appl. No.: 403,970

[22] Filed: Mar. 15, 1995

[51] Int. Cl.[6] ..... F23J 1/06

[52] U.S. Cl. ..... 110/170; 110/290

[58] Field of Search ..... 110/165 A, 165 R, 110/169, 170, 259, 289, 290

[56] References Cited

U.S. PATENT DOCUMENTS

| | | | |
|---|---|---|---|
| 946,553 | 1/1910 | Mitchell | 110/170 |
| 1,535,649 | 4/1925 | Bronder . | |
| 4,286,527 | 9/1981 | Robinson et al. | 110/165 A |
| 4,479,808 | 10/1984 | Campbell . | |
| 5,082,572 | 1/1992 | Schmidt | 110/165 A X |

*Primary Examiner*—Henry A. Bennett
*Assistant Examiner*—Susanne C. Tinker
*Attorney, Agent, or Firm*—Dunlap & Codding, P.C.

[57] ABSTRACT

A lump breaker apparatus mounted to an airlock of an economizer ash hopper for breaking up ash clinkers accumulated on a grating disposed in the airlock to maintain the passage of ash through the grating of the airlock. The apparatus comprising a pneumatic cylinder having a rod extending therefrom with a ramming plate connected to a distal end thereof and slidably disposed on the grating of the airlock, a mounting assembly for mounting the cylinder to the airlock and a seal assembly for providing a slidable seal about the rod. The ramming plate reciprocally movable from a retracted position to an extended position along the grating to impact the ash clinkers on the grating of the airlock with sufficient force to fragment such ash clinkers and to permit the passage of some ash clinkers through the grating.

23 Claims, 3 Drawing Sheets

ECONOMIZER LUMP BREAKER

BACKGROUND OF THE INVENTION

1. Field of the Invention

The present invention is generally related to crushing devices, and more particularly, but not by way of limitation, to an improved apparatus sealingly mounted to an airlock of an economizer ash hopper for breaking up ash clinkers and other deposits accumulated in the airlock to maintain passage of fly ash through the airlock.

2. Description of Related Art

Boilers employed in power plants are often heated by burning coal. The by-product of the combustion of coal is ash. This resultant ash is categorized as either bottom ash or fly ash. Bottom ash comprises accumulations of ash which are heavy enough to fall down through the boiler. The bottom ash is collected in a hopper positioned beneath the boiler. Fly ash comprises smaller particles of ash which are light enough to be carried up through the boiler with the flue gas.

A boiler is typically provided with several economizers which are positioned toward the downstream end of the boiler to utilize the hot flue gas in the boiler to preheat water returning from the turbines and condensers. As fly ash passes by the economizers, a portion of the ash deposits and accumulates on the outside of the economizers. To maintain the effectiveness of the economizers, the ash must be periodically removed. The removed deposits, which include ash clinkers, slag and other accumulated deposits, are collected in an economizer hopper positioned beneath the economizers.

The ash collected in the hopper is passed from the hopper to a pneumatic conveying system via an airlock. To pass the ash to the airlock, a vacuum is created in the airlock and an upper gate interposed between the hopper and the airlock is opened thereby causing the ash to be pulled into the airlock. When the airlock is filled, the upper gate is closed and the airlock is pressurized. A lower gate is then opened thereby forcing the ash from the airlock to the conveying system.

A V-shaped grating is disposed within the airlock to collect deposits of ash which are too large to be carried by the conveying system. After a period of time, the grating can become blocked by an accumulation of ash clinkers thereby preventing ash from passing from the airlock and causing the airlock to be rendered inoperable. Consequently, the ash clinkers accumulated on the grating must be frequently removed and the grating cleaned to ensure that the airlock continues to operate properly. However, such a task is time consuming and thus costly.

To this end, a need has long existed for an apparatus mounted to the airlock of an economizer ash hopper for breaking up ash clinkers accumulated on the grating disposed in the airlock thereby reducing the time and expense involved in cleaning the grating. It is to such an apparatus that the present invention is directed.

DETAILED DESCRIPTION

Figure 1:
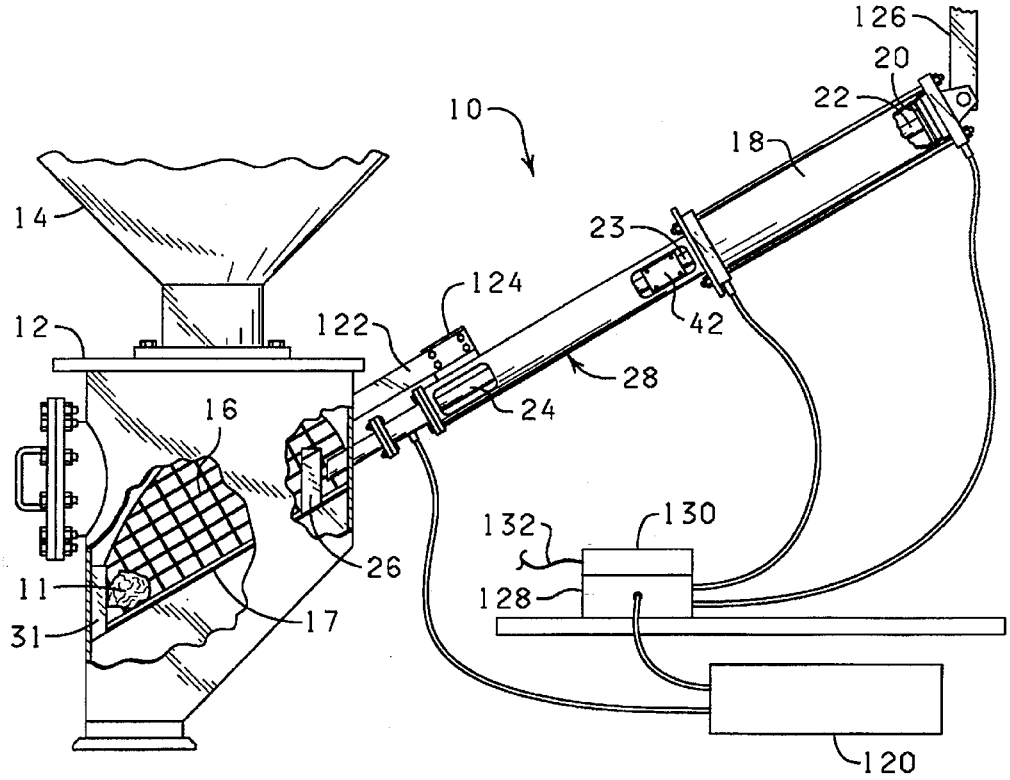
FIG. 1 is a partially cutaway, elevational view of a lump breaker apparatus constructed in accordance with the present invention shown mounted to an airlock of an economizer hopper with the apparatus in a retracted position.
Figure 2:
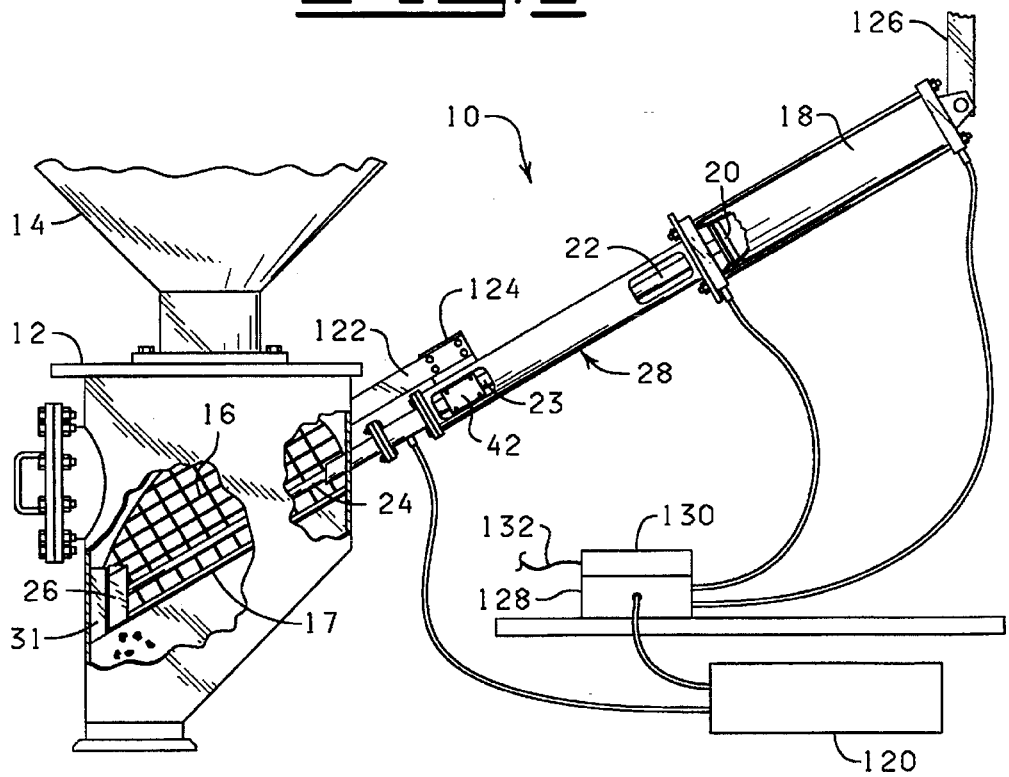
FIG. 2 is a partially cutaway, elevational view of the lump breaker apparatus of the present invention shown in an extended position.

Referring now to the drawings, and more particularly to FIGS. 1 and 2, a lump breaker apparatus 10 constructed in accordance with the present invention for breaking up ash clinkers 11 in an airlock 12 of an economizer hopper 14 is illustrated. The lump breaker apparatus 10 is shown mounted to the airlock 12 which is mounted to the bottom of the hopper 14.

As mentioned above, ash removed from an economizer is collected in the hopper 14 and passed to a pneumatic conveying system (not shown) via the lower end of the airlock 12. The airlock 12 has an upper gate (not shown) and a lower gate (also not shown) which permits the ash to be selectively passed from the hopper 14 to the conveying system. That is, the airlock 12 has a filling cycle wherein the upper gate is open and ash is passed into the airlock 12 and accumulated therein and a discharge cycle wherein the accumulated ash is passed to the conveying system via the lower gate.

During the filling cycle, a vacuum is pulled in the airlock 12 to facilitate the passage of ash from the hopper 14 to the airlock 12. The vacuum must be sufficient to overcome the vacuum formed across the top end of the hopper 14 as a result of the flow of hot flue gas across the top of the hopper 14. During the discharge cycle, the airlock is pressurized to a pressure of 16–20 psi to force the ash from the airlock 12 and into the conveying system.

The airlock 12 is provided with a V-shaped grating 16 which is angularly disposed in the airlock 12 to collect ash clinkers and other deposits that are too large to be efficiently carried by the conveying system. A rail 17 is extended across the airlock 12 over the medial portion of the grating 16 to support the grating 16. The rail 17 is typically a piece of angle iron and is disposed such that a groove is provided along the trough of the grating 16.

After several filling and discharge cycles, a number of ash clinkers accumulate on the grating thereby impeding the passage of ash through the airlock 12. Consequently, the ash clinkers must either be removed from the grating or the ash clinkers must be reduced to a size which allows the ash clinkers to pass through the grating 16. Removal of the ash clinkers from the grating is costly and time consuming in that the airlock must be unsealed and thus taken out of operation for a period of time. To this end, it is preferable to be able to periodically crush the accumulated ash clinkers without having to interrupt the operation of the airlock 12.

The lump breaker apparatus 10 of the present invention effectively crushes ash clinkers accumulated on the grating 16 of the airlock 12 so as to produce fragments which are able to pass through the grating 16 without requiring the expenditure of manpower and the cost associated with taking the airlock 12 out of operation to clean the grating 16.

Figure 6:
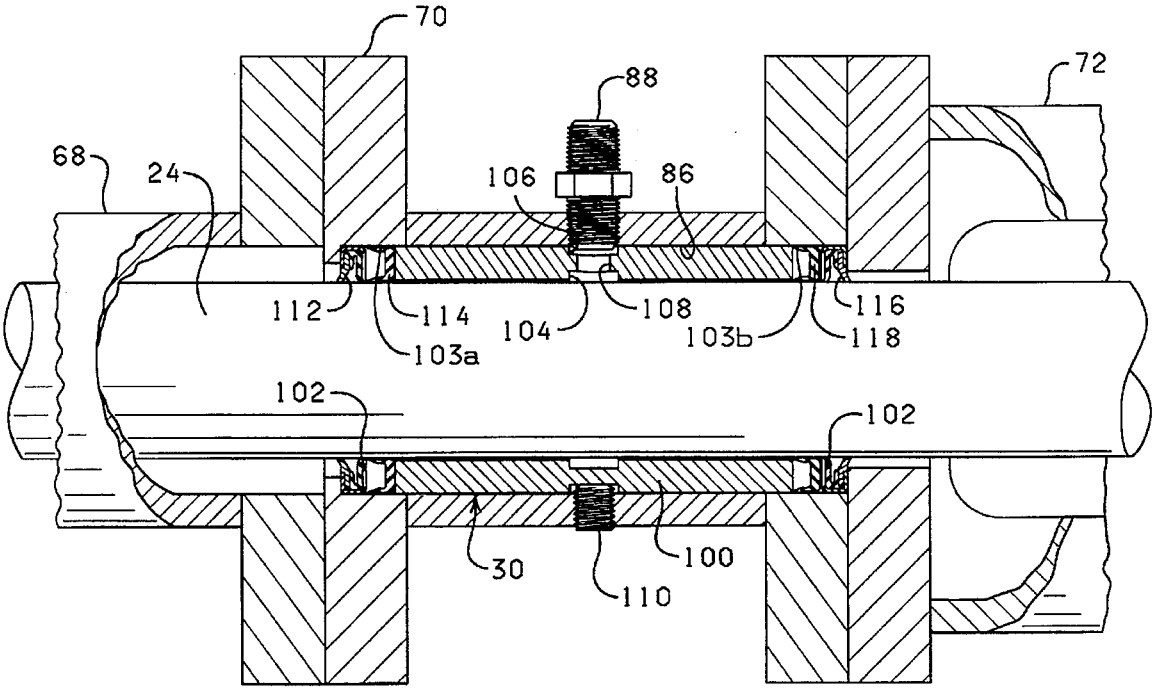
FIG. 6 is a partially cutaway, elevational view of a seal bushing mount showing a seal assembly disposed therein sealingly engaged about the extension rod.

The lump breaker apparatus 10 includes a cylinder 18 having a piston 20 slidably disposed therein, a rod 22 extending from the piston 20, a ramming plate 26 connected to the distal end of the rod 22, a cylinder mounting assembly 28 and a seal assembly 30 (FIG. 6). The rod 22 includes a piston rod 23 coupled to an extension rod 24 wherein the extension rod 24 is disposed through the airlock 12 so that the ramming plate 26 is slidably disposed on the upper side of the grating 16. The cylinder 18 is positionable in a retracted position (FIG. 1) wherein the ramming plate 26 is positioned at the upper end of the grating 16, and an extended position (FIG. 2) wherein the ramming plate 26 is moved down the grating 16 to strike the ash clinkers 11 with a force sufficient to crush the ash clinkers accumulated on the grating 16. The airlock 12 can be provided with a reinforcing plate 31 disposed on the interior of the airlock 12 to reinforce the airlock 12 and cooperate with the ramming plate 26 to crush the ash clinkers.

Figure 3:
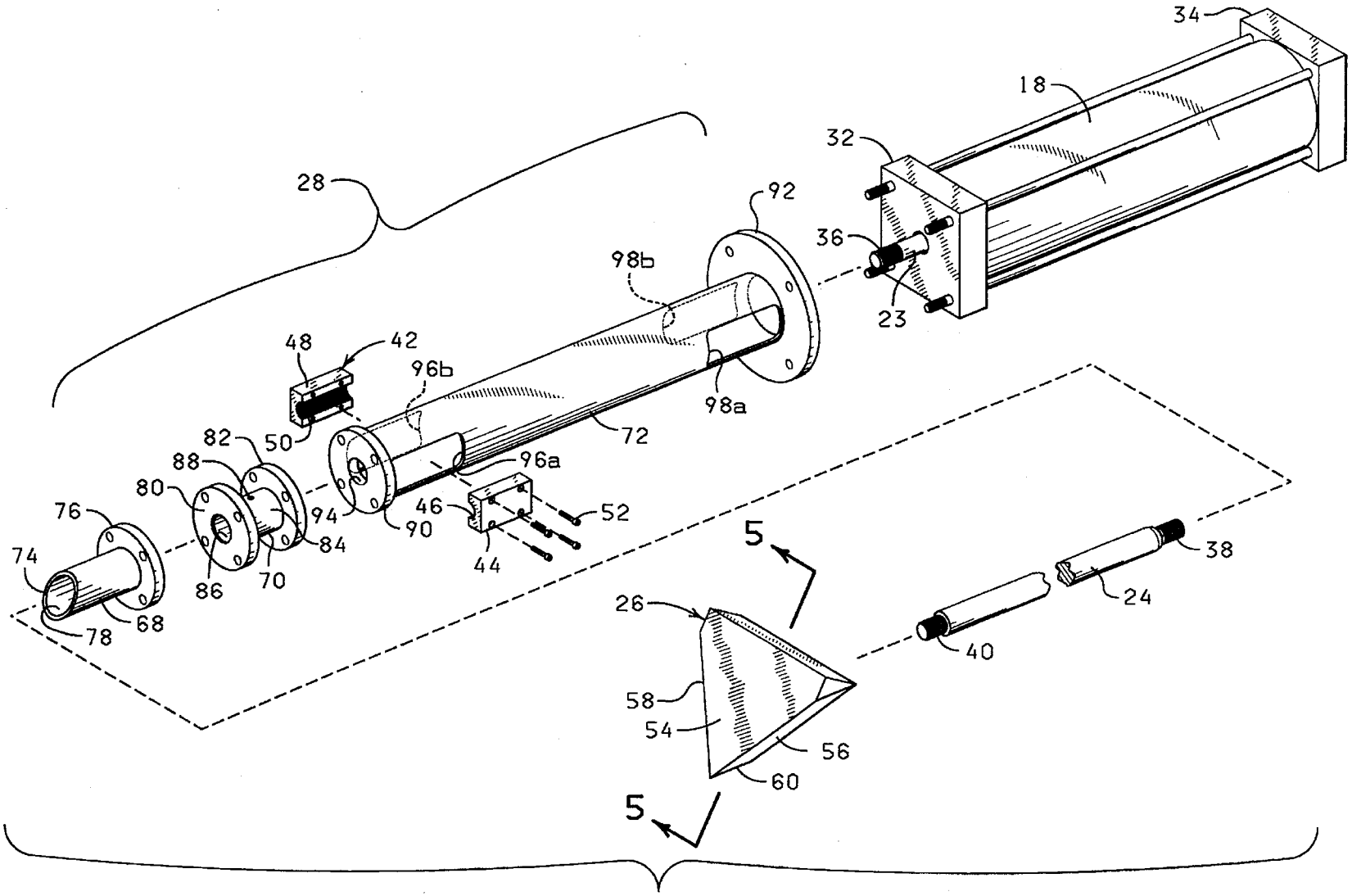
FIG. 3 is an exploded, perspective view of the lump breaker of the present invention.

Referring now to FIG. 3, the cylinder 18, the cylinder mounting assembly 28, the extension rod 24, and the ramming plate 26 are shown in an exploded view. The cylinder 18 is characterized as having a first end 32 and a second end 34 with the piston rod 23 extending from the first end 32 of the cylinder 18. The piston rod 23 has a threaded end portion 36. The cylinder 18 is preferably a standard double-acting pneumatic cylinder with a stroke length of approximately 21 inches. While it will be appreciated that the size of the cylinder can be varied, it is important that the cylinder be of sufficient size to produce a force of approximately 2,800 psi in order to effectively break up most ash clinkers.

The extension rod 24 has a first threaded end portion 38 and a second threaded end portion 40. The piston rod 23 and the extension rod 24 are coupled together with a split-type coupling 42 which is adapted to couple the threaded end portion 36 of the piston rod 23 to the first threaded end portion 38 of the extension rod 24. That is, the coupling 42 includes a first section 44 having a threaded semi-circular slot 46 disposed therein and a second section 48 having a threaded semi-circular slot 50 disposed therein. The slots 46 and 50 cooperate to form a threaded bore when the first section 44 is connected to the second section 48 with the threaded slots 46 and 50 positioned adjacent to one another.

The piston rod 23 and the extension rod 24 are coupled to one another by disposing the threaded end portion 36 of the piston rod 23 and the second threaded end portion 40 of the extension rod 24 between the first and second sections 44 and 48 and connecting the first and second sections 44 and 48 together with a plurality of bolts 52. Utilization of the split-type coupling 42 facilitates the assembly and mounting of the lump breaker apparatus 10 to the airlock 12 as will be discussed in further detail below.

Figure 4:
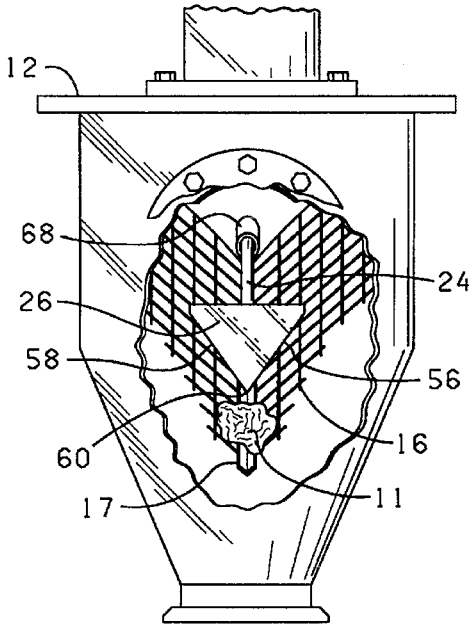
FIG. 4 is a partially cutaway, front view of the airlock showing the ramming plate disposed on the grating.
Figure 5:
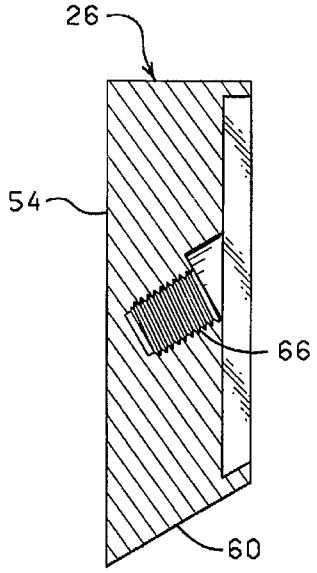
FIG. 5 is a cross-sectional view of the ramming plate taken at line 5—5 in FIG. 3.

As best shown in FIGS. 3–5, the ramming plate 26 is adapted to be threadingly connected to the second threaded end portion 40 of the extension rod 24 and is shaped to substantially conform to the V-shaped grating 16 such that the ramming plate 26 effectively impacts the ash clinkers disposed along the grating as the ramming plate 26 slides down the grating 16. The ramming plate 26 is of unitary construction and made of a hard, durable material, such as steel. The ramming plate 26 comprises a substantially flat clinker striking surface 54, a pair of tapered guide surfaces 56, 58 and an angular bottom edge 60. The guide surfaces 56 and 58 are tapered such that the guide surfaces 56 and 58 slidingly engage the grating 16 as the ramming plate 26 is moved between the retracted position and the extended position. The intersection of the guide surfaces 56 and 58 is angled to form the angular bottom edge 60. When the ramming plate 26 is operably disposed in the airlock 12 as shown in FIGS. 1, 2 and 4, the angular bottom edge 60 is disposed in the rail 17 of the grating 16 while the striking surface 54 extends vertically so that the striking surface 54 is parallel to the vertical sidewall of the airlock 12.

A female coupling 66 dimensioned to threadingly receive the second threaded end portion 40 of the extension rod 24 is provided on the back of the ramming plate 26. The coupling 66 is formed at an angle so that the angular bottom edge 60 is parallel to the extension rod 24 when the ramming plate 26 is connected to the extension rod 24.

The cylinder 18 is mounted to airlock 12 via the cylinder mounting assembly 28. The mounting assembly 28 is adapted to permit a fluid-tight seal to be formed about the extension rod 24, while also making the lump breaker apparatus 10 easy to assemble and disassemble. The cylinder mounting assembly 28 includes a transition bushing 68, a seal bushing mount 70, and a cylinder mounting member 72.

The transition bushing 68 is a tubular member having a first end 74, a second end 76, and an internal bore 78 extending therebetween. The second end 76 is flanged to facilitate connection with seal bushing mount 70. The transition bushing 68 is disposed through the sidewall of the airlock 12, as substantially shown in FIGS. 1 and 2, to provide a passageway into the airlock 12 which is substantially parallel to the grating 16 of the airlock 12 and substantially aligned with the trough of the grating 16, as best shown in FIG. 4. A seal is formed between the outside of the transition bushing 68 and the airlock 12 by seal welding the transition bushing 68 to the sidewall of the airlock 12.

The seal bushing mount 70 which is for housing the seal assembly 30 (FIG. 6), has a first flanged end 80, a second flanged end 82, a medial portion 84, and an internal bore 86 extending between the first flanged end 80 and the second flanged end 82 thereof. The seal bushing mount 70 is further provided with an air inlet port 88 disposed therethrough at the medial portion 84 to permit the injection of air into the internal bore 86 of the seal bushing mount 70 in a manner to be discussed below. The first flanged end 80 of the seal bushing mount 70 is connectable to the second end 76 of the transition bushing 68.

The cylinder mounting member 72 includes a first flanged end 90, a second flanged end 92, and an internal bore 94 extending between the first end 90 and the second end 92 thereof. The first end 90 of the cylinder mounting member 72 is connected to the second end 82 of the seal bushing mount 70 and the first end of the cylinder 18 is connected to the second end 92 of the cylinder mounting member 72. The internal bore 94 is adapted to receive the coupling 42 such that the coupling 42 is located in the cylinder mounting member 72 when the lump breaker apparatus 10 is assembled with the extension rod 24 connected to the piston rod 23. The internal bore 94 of the cylinder mounting member 72 is dimensioned so that the coupling 42 moves back and forth through the cylinder mounting member 72 as the cylinder 18 is actuated between the retracted position and the extended position.

To permit access to the coupling 42 and thus enable the extension rod 24 to be easily connected and disconnected from the piston rod 23, the cylinder mounting member 72 is provided with a first pair of openings **96*a*, 96*b* and second pair of openings 98*a*, 98*b*. The openings 96*a* and 96*b* are oppositely disposed in the cylinder mounting member 72 near the first end 90 thereof such that the coupling 42 will be aligned with the openings 96*a* and 96*b* when the cylinder 18 is in the extended position. The openings 98*a* and 98*b* are oppositely disposed in the cylinder mounting member 72 near the second end 92 thereof such that the coupling 42 will be aligned with the openings 98*a* and 98*b* when the cylinder 18 is in the retracted position. The openings 96*a*, 96*b*, 98*a***, 98*b* are dimensioned to permit the passage of one of the sections 44, 48 of the coupling 42. Thus, the extension rod 24 can be connected to or disconnected from the piston rod 23 when the cylinder 18 is in either the retracted position or the extended position.

Because the airlock 12 is pressurized to pass ash from the airlock 12 to the conveying system, it is critical that the airlock 12 be sealed to operate properly. To this end, the seal assembly 30 is provided to form a slidable seal about the extension rod 24 so that the airlock 12 remains fluid-tight. As illustrated in FIG. 6, the seal assembly 30 is disposed in the seal bushing mount 70 and comprises a seal bushing 100 and a plurality of seal members 102.

The seal bushing 100 is dimensioned to fit in the internal bore 86 of the seal bushing mount 70. The seal bushing 100 has a seal receiving cavity 103*a* in one end of the seal bushing 100 and a seal receiving cavity 103*b* in the other end of the seal bushing 100. The seal bushing 100 further has an internal annular groove 104 formed along the medial portion of the seal bushing 100, an external annular groove 106 concentrically disposed relative to the internal annular groove, and an aperture 108 disposed therethrough so as to intersect the internal annular groove 104 and the external annular groove 106 to provide fluid communication between the external annular groove 106 and the internal annular groove 104. The seal bushing 100 is secured in the seal bushing mount 70 in a suitable manner such as with a set screw 110.

The seal members 102 include a first scraper seal 112, a first U-cup seal 114, a second scraper seal 116 and a second U-cup seal 118. The seal members 102 are disposed into the seal receiving cavities 103*a* and 103*b* of the seal bushing 100 in a tandem relationship such that the first and second scraper seals 112, 116 are positioned outside the first and second U-cup seals 114, 118 and such that the first and second U-cup seals 114, 118 are positioned on either side of the inner annular groove 104. More specifically, the first scraper seal 112 and the first U-cup seal 114 are disposed in the seal receiving cavity 103*a* and the second scraper seal 116 and the second U-cup seal 118 are disposed in the seal receiving cavity 103*b*.

The first and second U-cup seals 114 and 118 are sized to provide a substantially fluid-tight seal about the extension rod 24 while also permitting the extension rod 24 to freely slide between the retracted position and the extended position. The first and second scraper seals 112, 116 are employed to keep the extension rod 24 free of debris, such as hot ash, which could damage the U-cup seals 114, 118.

As illustrated in FIGS. 1 and 2, a source of pressurized gas 120 such as air or other suitable gas, is connected to the air inlet port 88 of the seal bushing mount 70 to inject gas into the seal bushing 100 about the extension rod 24 via the aperture 108 of the seal bushing 100 between the first U-cup seal 114 and the second U-cup seal 118 to further prevent contamination of the seal members 102. The pressure of the air injected into the seal bushing mount 70 is regulated to a pressure of about 10 psi greater than the maximum pressure of the airlock 12 to ensure that the seal members 102 are not contaminated with ash. That is, because the injected gas has a greater pressure than the airlock pressure, if any leaks exist about the extension rod 24, air leakage will flow into the airlock 12 rather than from the airlock 12.

To assemble the lump breaker apparatus 10, the transition bushing 68 is first inserted into and seal welded to the airlock 12. With a passageway established into the airlock 12, the extension rod 24 is inserted through the transition bushing 68 from inside the airlock 12 with the ramming plate 26 connected to the first end 38 of the extension rod 24. With the ramming plate 26 slid to the upper portion of the grating 16 so that the second end 40 of the extension rod 24 fully extends from the transition bushing 68 as if the cylinder 18 was in the retracted position, an assembly of the seal bushing mount 70 with the seal assembly 30 secured therein, the cylinder mounting member 72, and the cylinder 18 is positioned on the extension rod 24, and the first flanged end 80 of the seal bushing mount 70 is then connected to the second flanged end 76 of the transition bushing 68. The extension rod 24 is then connected to the rod 22 with the coupling 42.

The lump breaker apparatus 10 is supported with a bracket 122 having one end welded to the outside of the airlock 12 and another end connected to an anchor plate 124 (FIGS. 1, 2 and 3) secured to the cylinder mounting member 72. The lump breaker apparatus 10 is further supported with a bracket 126 (partially shown in FIGS. 1 and 2) having one end connected to the second end 34 of the cylinder 18 and another end connected to a portion of the hopper 14 or other suitable support structure.

To actuate the cylinder 18, the source of pressurized gas 120 is connected to the first end 32 of the cylinder 18 and the second end 34 of the cylinder 18 in a conventional fashion with a manifold 128 and a solenoid valve 130 interposed between the source of pressurized gas 120 and the cylinder 18. The cylinder 18 can be actuated manually or automatically. If actuated automatically, the solenoid valve 130 can be controlled by electric signals sent by a programmable logic controller (PLC) (not shown) via a signal path 132. While the cylinder 18 can be actuated at any desirable interval, an example of a preferable crushing cycle is to program the PLC to actuate the cylinder 18 once every ten filling cycles of the airlock 12. That is, the PLC counts the number of times the upper gate of the airlock 12 opens and after the tenth time the PLC sends an electric signal to the solenoid valve 130. The solenoid valve 130 then directs the flow of gas to the second end 34 of the cylinder 18 which in turn drives the piston 20 toward the first end 32 of the cylinder 18 such that the cylinder 18 is moved to the extended position whereby the ramming plate 26 strikes and crushes the accumulated ash clinkers (FIG. 2). After a predetermined time interval, the solenoid valve 130 directs the flow of gas to the first end 32 of the cylinder 18 thereby returning the cylinder 18 to the retracted position (FIG. 1).

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. An apparatus for breaking up ash clinkers accumulated on a grating disposed in an airlock, the apparatus comprising:

a cylinder having a first end, a second end and a piston, the piston slidably disposed within the cylinder and having a rod extending therefrom and into the airlock;

seal means for providing a fluid-tight seal between the rod and the airlock;

a ramming plate connected to the rod; and actuating means for selectively actuating the piston so that the ramming plate is reciprocally movable from a retracted position to an extended position such that the ramming plate impacts the ash clinkers on the grating of the airlock in the extended position at a force sufficient to fragment such ash clinkers and permit the passage of same through the grating.

2. The apparatus of claim 1 wherein the ramming plate impacts the ash clinkers on the grating of the airlock with a force greater than about 2,800 psi.

3. The apparatus of claim 2 wherein the cylinder is automatically actuated from the retracted position to the extended position.

4. The apparatus of claim 1 wherein the seal means comprises:

at least one pair of seal members positioned between the airlock and the rod; and pressurized air means for passing pressurized air between the pair of seal members at a pressure greater than the interior pressure of the airlock.

5. The apparatus of claim 1 wherein the seal means comprises:

at least two pairs of seal members positioned between the airlock and the rod in a tandem relationship; and pressurized air means for passing pressurized air between the pairs of seal members at a pressure greater than the interior pressure of the airlock.

6. An apparatus for breaking up ash clinkers accumulated on a grating disposed in an airlock, the apparatus comprising:

a cylinder having a first end, a second end, and a piston, the piston slidably disposed within the cylinder and having a rod extending therefrom and into the airlock;

a ramming plate connected to the rod and slidably disposed on the grating in the airlock;

a seal bushing mount having a first end, a second end, and an internal bore extending between the first end and the second end thereof, the seal bushing mount interposed between the airlock and the cylinder;

a seal assembly disposed in the seal bushing mount for providing a fluid-tight seal between the rod and the airlock, the seal assembly comprising:

a seal bushing disposed in the internal bore of the seal bushing mount; and a plurality of seal members including a first scraper seal, a first U-cup seal, a second scraper seal, and a second U-cup seal disposed in the seal bushing in a tandem relationship such that the first and second scraper seals are positioned outside the first and second U-cup seals; and actuating means for selectively actuating the piston so that the ramming plate is reciprocally movable from a retracted position to an extended position such that the ramming plate impacts the ash clinkers on the grating of the airlock in the extended position at a force sufficient to fragment such ash clinkers and permit the passage of same through the grating.

7. The apparatus of claim 6 wherein the seal bushing mount is provided with an air inlet port disposed therethrough at a medial portion thereof to permit the injection of air into the internal bore of the seal bushing mount, wherein the seal bushing is provided with an internal annular groove formed along a medial portion of the seal bushing, an external annular groove concentrically disposed relative to the internal annular groove, and an aperture disposed through the seal bushing intersecting the internal annular groove and the external annular groove to provide fluid communication therebetween, wherein the first and second U-cup seals are positioned on either side of the internal annular groove, and wherein the apparatus further comprises:

a pressurized gas supply coupled to the air inlet port of the seal bushing mount to pass gas having a pressure greater than the interior pressure of the airlock into the seal bushing between the first U-cup seal and the second U-cup seal to prevent contamination of the seal members.

8. An apparatus for breaking up ash clinkers accumulated on a grating disposed in an airlock, the apparatus comprising:

a cylinder having a first end, a second end, and a piston, the piston slidably disposed within the cylinder and having a rod extending therefrom and into the airlock;

a transition bushing having a first end, a second end, and an internal bore dimensioned to slidably receive the rod extending therebetween, the transition bushing disposed through and connected to the airlock so as to provide a passageway into the airlock which is substantially parallel to the grating of the airlock, the first end of the cylinder connected to the second end of the transition bushing with the rod disposed therethrough;

a ramming plate connected to the rod and slidably disposed on the grating in the airlock; and actuating means for selectively actuating the piston so that the ramming plate is reciprocally movable from a retracted position to an extended position such that the ramming plate impacts the ash clinkers on the grating of the airlock in the extended position at a force sufficient to fragment such ash clinkers and permit the passage of same through the grating.

9. The apparatus of claim 8 wherein the rod comprises a piston rod and an extension rod, the extension rod having a first end detachably coupled to the piston rod and a second end connected to the ramming plate, the extension rod slidably and sealingly disposed into the airlock such that a fluid-tight seal is formed between the extension rod and the airlock.

10. The apparatus of claim 9 wherein the piston rod has a threaded end portion, wherein the first end of the extension rod is threaded, and wherein the apparatus further comprises:

a cylinder mounting member having a first end, a second end, and an internal bore extending between the first end and the second end thereof, the cylinder mounting member interposed between the cylinder and the transition flange; and a coupling adapted to couple the threaded end portion of the piston rod to the threaded first end of the extension rod, the coupling including a first section having a threaded slot disposed therein and a second section having a threaded slot disposed therein wherein the first and second sections of the coupling cooperate to form a threaded bore in which the first threaded end portion of the extension rod and the threaded end portion of the piston rod are oppositely disposed when the first and second sections are connected, the coupling dimensioned to be slidably disposed in the internal bore of the cylinder mounting member.

11. The apparatus of claim 10 wherein the cylinder mounting member is provided with a first pair of openings and a second pair of openings, the first pair of openings oppositely disposed in the cylinder mounting member near the first end thereof and the second pair of openings oppositely disposed in the cylinder mounting member near the second end thereof, each of the openings sized to receive one of the first and second sections of the couplings such that the extension rod can be selectively connected to and disconnected from the piston rod when the cylinder is in one of the retracted position and the extended position.

12. The apparatus of claim 11 further comprising:

a seal bushing mount having a first end, a second end, and an internal bore extending between the first end and the second end thereof, the seal bushing mount interposed between the transition bushing and the cylinder mounting member; and a seal assembly disposed in the seal bushing mount for providing a slidable seal about the extension rod, the seal assembly, comprising:

a seal bushing disposed in the seal bushing mount; and a plurality of seal members including a first scraper seal, a first U-cup seal, a second scraper seal and a second U-cup seal disposed in the seal bushing in a tandem relationship such that the first and second scraper seals are positioned outside the first and second U-cup seals.

13. The apparatus of claim 12 wherein the seal bushing mount is provided with an air inlet port disposed therethrough at a medial portion thereof to permit the injection of air into the internal bore of the seal bushing mount, wherein the seal bushing is provided with an internal annular groove formed along a medial portion of the seal bushing, an external annular groove concentrically disposed relative to the internal annular groove, and an aperture disposed through the seal bushing intersecting the internal annular groove and the external annular groove to provide fluid communication therebetween, wherein the first and second U-cup seals are positioned on either side of the inner annular groove, and wherein the apparatus further comprises:

a pressurized gas supply coupled to the air inlet port of the seal bushing mount to pass gas having a pressure greater than the interior pressure of the airlock into the seal bushing between the first U-cup seal and the second U-cup seal to prevent contamination of the seal members.

14. An apparatus for breaking up ash clinkers accumulated on a grating disposed in an airlock, the grating being V-shaped and angularly disposed in the airlock, the apparatus comprising:

a cylinder having a first end, a second end, and a piston, the piston slidably disposed within the cylinder and having a rod extending therefrom and into the airlock;

a ramming plate connected to the rod and slidably disposed on the grating in the airlock, the ramming plate shaped to substantially conform to the shape of the grating; and actuating means for selectively actuating the piston so that the ramming plate is reciprocally movable from a retracted position to an extended position such that the ramming plate impacts the ash clinkers on the grating of the airlock in the extended position at a force sufficient to fragment such ash clinkers and permit the passage of same through the grating.

15. An apparatus mounted to an airlock of an economizer ash hopper for breaking up ash clinkers accumulated on a grating disposed in the airlock to maintain the passage of ash through the grating of the airlock, the apparatus comprising:

a transition bushing having a first end, a second end, and an internal bore extending therebetween, the transition bushing disposed through and connected to the side wall of the airlock so as to provide a passageway through the airlock;

a seal bushing mount having a first end, a second end, a medial portion, and an internal bore extending between the first end and the second end thereof, the seal bushing mount having an air inlet port disposed therethrough at the medial portion to permit the injection of air into the internal bore of the seal bushing mount, the first end of the seal bushing connected to the second end of the transition bushing;

a cylinder mounting member having a first end, a second end, and an internal bore extending between the first end and the second end thereof, the first end of the cylinder mounting member connected to the second end of the seal bushing mount;

a cylinder having a first end, a second end and a piston, the piston rod extending from the first end of the cylinder and the first end of the cylinder connected to the second end of the cylinder mounting member, the piston slidably disposed within the cylinder and having a piston rod extending therefrom, such that the piston rod extends from the first end of the cylinder and into the internal bore of the cylinder mounting member;

an extension rod having a first end and a second end, the extension rod slidably disposed in the internal bores of the cylinder mounting member, the seal bushing mount, and the transition bushing, the first end of the extension rod coupled to the piston rod;

a ramming plate connected to the second end of the extension rod and slidably disposed on the grating of the airlock;

a seal assembly disposed in the seal bushing mount for providing a slidable seal about the extension rod, the seal assembly comprising:

a seal bushing disposed in the internal bore of the seal bushing mount, an internal annular groove formed along the medial portion, an external annular groove concentrically disposed relative to the internal annular groove, and an aperture disposed through the seal bushing intersecting the internal annular groove and the external annular groove to provide fluid communication therebetween; and a plurality of seal members including a first scraper seal, a first U-cup seal, a second scraper seal and a second U-cup seal disposed in the seal bushing in a tandem relationship such that the first and second scraper seals are positioned outside the first and second U-cup seals and such that the first and second U-cup seals are positioned on either side of the inner annular groove;

actuating means for selectively actuating the piston so that the ramming plate is reciprocally movable from a retracted position to an extended position such that the ramming plate impacts the ash clinkers on the grating of the airlock in the extended position at a force sufficient to fragment such ash clinkers and permit the passage of same through the grating; and a pressurized gas supply coupled to the air inlet port of the seal bushing mount to pass gas having a pressure greater than the interior pressure of the airlock into the seal bushing between the first U-cup seal and the second U-cup seal to prevent contamination of the seal members.

16. The apparatus of claim 15 wherein the piston rod has a threaded end portion, wherein the first end of the extension rod is threaded, and wherein the apparatus further comprises:

a coupling adapted to couple the threaded end portion of the piston rod to the threaded first end of the extension rod, the coupling including a first section having a threaded slot disposed therein and a second section having a threaded slot disposed therein wherein the first and second sections of the coupling cooperate to form a threaded bore in which the first threaded end portion of the extension rod and the threaded end portion of the piston rod are oppositely disposed when the first and second sections are connected, the coupling dimensioned to be slidably disposed in the internal bore of the cylinder mounting member.

17. The apparatus of claim 16 wherein the cylinder mounting member is provided with a first pair of openings and a second pair of openings, the first pair of openings oppositely disposed in the cylinder mounting member near the first end thereof and the second pair of openings oppositely disposed in the cylinder mounting member near the second end thereof, each of the openings sized to receive one of the first and second sections of the couplings such that the extension rod can be selectively connected to and disconnected from the piston rod when the cylinder is in one of the retracted position and the extended position.

18. The apparatus of claim 15 wherein the ramming plate impacts the ash clinkers on the grating of the airlock with a force greater than about 2,800 psi.

19. The apparatus of claim 18 wherein the cylinder is automatically actuated from the retracted position to the extended position.

20. The apparatus of claim 15 wherein grating is V-shaped and angularly disposed in the airlock, and wherein the ramming plate is shaped to substantially conform to the shape of the grating.

21. An apparatus for breaking up ash clinkers accumulated on a grating disposed in an airlock, the apparatus comprising:

a cylinder having a piston slidably disposed therein, the piston having a rod extending therefrom, the cylinder adapted to be connected to the airlock so that the rod extends into the airlock;

a ramming plate connected to the rod;

seal means for providing a fluid-tight seal between the rod and the airlock when the cylinder is connected to the airlock; and actuating means for selectively actuating the piston so that the ramming plate is reciprocally movable from a retracted position to an extended position whereby the ramming plate impacts the ash clinkers on the grating of the airlock in the extended position at a force sufficient to fragment such ash clinkers and permit the passage of same through the grating.

22. The apparatus of claim 21 wherein the seal means comprises:

at least one pair of seal members positioned between the airlock and the rod; and pressurized air means for passing pressurized air between the pair of seal members at a pressure greater than the interior pressure of the airlock.

23. The apparatus of claim 21 wherein the seal means comprises:

at least two pairs of seal members positioned between the airlock and the rod in a tandem relationship; and pressurized air means for passing pressurized air between the pairs of seal members at a pressure greater than the interior pressure of the airlock.

* * * * *